United States Patent [19]

Bousaid

[11] Patent Number: 4,638,864

[45] Date of Patent: Jan. 27, 1987

[54] RECOVERY OF HEAVY CRUDE OIL FROM SHALLOW FORMATIONS BY IN SITU COMBUSTION

[75] Inventor: Issam S. Bousaid, Houston, Tex.

[73] Assignee: Texaco Inc., White Plains, N.Y.

[21] Appl. No.: 667,669

[22] Filed: Nov. 2, 1984

[51] Int. Cl.[4] ..... E21B 43/243

[52] U.S. Cl. ..... 166/251; 166/261; 166/269

[58] Field of Search ..... 166/251, 261, 269

[56] References Cited

U.S. PATENT DOCUMENTS

| | | | |
|---|---|---|---|
| 3,150,715 | 9/1964 | Dietz | 166/261 |
| 3,369,601 | 2/1968 | Bond et al. | 166/261 X |
| 3,727,686 | 4/1973 | Prates et al. | 166/261 |
| 3,978,920 | 9/1976 | Bandyopadhyay et al. | 166/261 X |
| 4,042,026 | 8/1977 | Pusch et al. | 166/261 X |
| 4,068,715 | 1/1978 | Wu | 166/251 |
| 4,415,031 | 11/1983 | Hunt, III | 166/261 |
| 4,493,369 | 1/1985 | Odeh et al. | 166/261 |

FOREIGN PATENT DOCUMENTS

| | | | |
|---|---|---|---|
| 1020861 | 11/1977 | Canada | 166/261 |

*Primary Examiner*—George A. Suchfield

*Attorney, Agent, or Firm*—Robert A. Kulason; James J. O'Loughlin; Robert B. Burns

[57] ABSTRACT

This invention comprises two steps for improving in situ combustion in shallow reservoirs: (1) use small well patterns preferably with injection to producing wells distance about 200 to 250 feet; and (2) after the front reaches a distance where the air flux is about 5 SCF/(ft$^2$-hr), or expressed another way, where the rate of frontal advance is about 0.4 ft/day, allow the air to "ride" on top of the pay zone while simultaneously water is injected at the oil-water contact below the air entry at the sand face of the injection well.

7 Claims, 2 Drawing Figures

RECOVERY OF HEAVY CRUDE OIL FROM SHALLOW FORMATIONS BY IN SITU COMBUSTION

SUMMARY OF THE INVENTION

The performance of an in situ combustion process for the recovery of petroleum from underground formations containing heavy crude oil encounters special problems when the formation to be produced, i.e. the "pay" zone, is at a shallow depth. The reason is that care must be taken that the injected air not exceed the presssure at which it would break through to the surface, and this limitation of the pressure brings with it a number of problems which arise from the nature of the in situ combustion process. I have found that a reduced pressure of injection and the resulting reduced pressure at the combustion front are accompanied by the following conditions:

(1) reduced temperature at the combustion front,
(2) reduced thickness of the combustion front,
(3) reduced rate of fuel consumption, and
(4) increased velocity of the combustion front.

A limit is reached where the combustion front thickness is so small that efficient combustion can no longer take place. In field operations such low efficiency combustion leads to random and isolated burn fronts with resulting drop in oil production. Once this deterioration of the combustion front begins, it is not possible to revive the front by increasing the air injection rate, as higher rates will only cool the front further.

A limit on the allowable pressure of injected air places a limit on the volume rate of injected air in SCF/hr, which for any given distance from the injection well to the combustion front, places a limit on the air flux or area rate of air flow at the front in SCF/($ft^2$—hr). Alternatively, since there is a lower practical limit for air flux, as set forth below, there is a limit on the distance from injection well to combustion front and a corresponding limit on the size of well pattern that can be swept by an in situ combustion process in a shallow reservoir.

An empirical relationship has been found between the air flux at the burn front, the fuel concentration consumed, and the rate of advance of the burn front. Also, from combustion tube results another relationship has been obtained for the air requirement, expressed in SCF air which reacts with the in situ fuel per $ft^3$ of "burned rock". These two relationships enable a determination to be made of the time duration of an in situ combustion process until a condition is reached at which it is no longer economical to continue the process.

It has been found advantageous in carrying out in situ combustion in shallow reservoirs to employ in a first operating stage small well patterns, e.g. 2 to 3 acres, with injection to producing wells distance about 200 to 250 feet, and then in a second operating stage, after the front reaches a distance where it is no longer economical to continue the process, to allow the air to "ride" on top of the pay zone while simultaneously water is injected at the oil-water contact below the air entry at the sand face of the injection well. The injected air "riding" the top of the pay zone spreads and sustains a larger combustion area and thus heats a greater reservoir volume.

Empirical relationships and equations are provided herein by which the operator is enabled to determine at what point to switch from the first operating stage to the second operating stage.

BRIEF DESCRIPTION OF THE DRAWINGS

The foregoing and other objects and benefits of the invention will be more fully set forth below in connection with the best mode contemplated by the inventor of carrying out the invention, and in connection with which there are illustrations provided in the drawings, wherein.

DESCRIPTION OF PREFERRED EMBODIMENT

Figure 1:
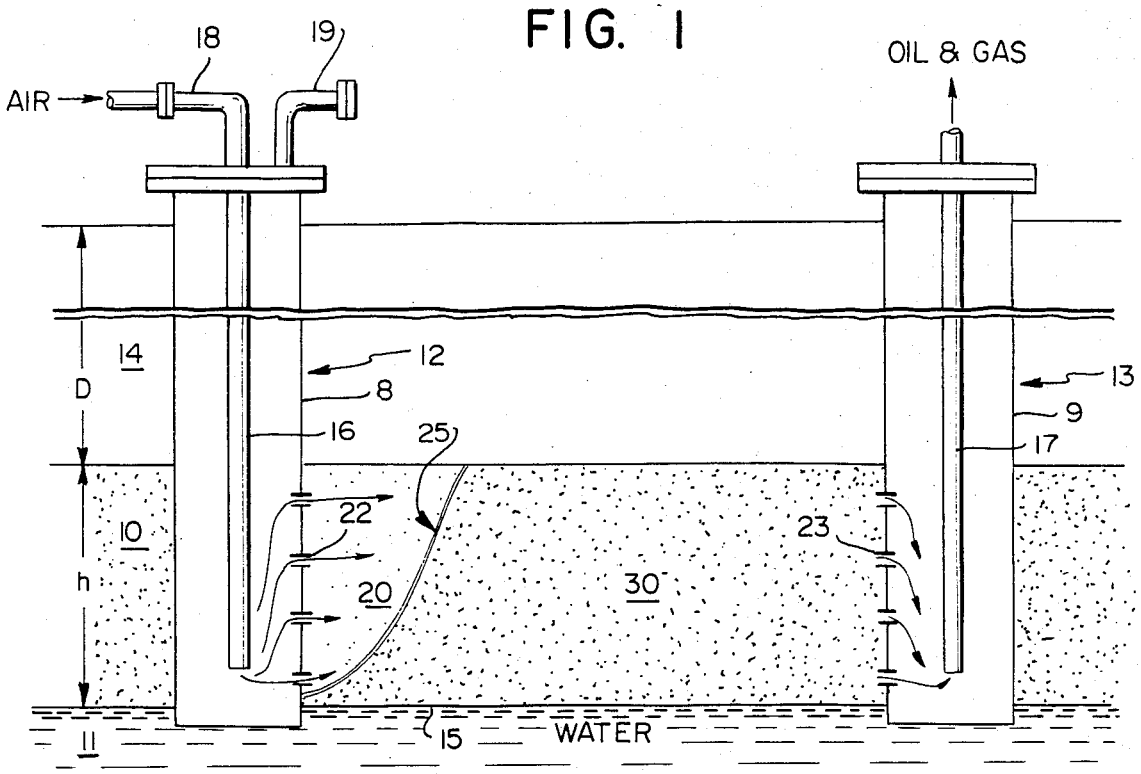
FIG. 1 illustrates a vertical plane view of a subterranean oil-containing formation or sand penetrated by an injection well and a production well during the first stage of operation according to this invention, which is similar to a conventional in situ combustion operation.

The invention deals with improving heavy crude oil recovery by in situ combustion in shallow formations. Because combustion of crude oils by air is greatly dependent on the amount of fuel and the oxidation temperature within the burning zone, firefloods often fail to maintain a radial or uniform combustion zone as the front moves away from the air injection well. The distance from the injection well to the high temperature front is limited by the ability of the burning zone to consume fuel at an increasing rate in order to sustain the high temperature (700° F. and greater) required for efficient combustion. As the combustion front progresses through the oil zone, the injection pressure decreases which affects both fuel consumption and width or thickness of the combustion zone. The reservoir volume to be heated at the front also increases as the radial distance from the injection well increases.

Laboratory combustion tests show that less fuel is consumed at lower pressures, and more importantly, the front temperature decreases as fuel consumption is decreased. Combustion tube experiments indicate that the burning zone or combustion front is usually less than one inch thick over which most oxidation of fuel occurs.

Combustion kinetics tests made on a thin fixed-bed (1.5 cm long) of sand saturated with oil and brine show that the front thickness is dependent on pressure and temperature. The width of efficient combustion where most oxygen is utilized remains small as expected; however, the front thickness increases as the reaction temperature increases. This increase is more significant at the higher air pressure as shown in Table 1.

TABLE 1

COMBUSTION FRONT THICKNESS IN CENTIMETERS RESULTS OF KINETICS TEST ON 21° API CRUDE OIL

| | Combustion Temperature | | | |
|---|---|---|---|---|
| Air Pressure at | 710° F. | 805° F. | 900° F. | 1100° F. |
| 0 psig | 0.31 cm | 0.73 cm | 0.82 cm | 0.92 cm |
| 50 psig | | | 0.98 cm | |
| 100 psig | 0.84 cm | 0.91 cm | 0.92 cm | 1.34 cm |

The decrease in burning zone thickness as the front temperature is decreased is accelerated at low pressures, and a front thickness is reached below which efficient combustion can no longer exist. This behavior is usually observed in the field where poor oxidation leads to random and isolated combustion within the reservoir. At such time, the in situ combustion process becomes inefficient which results in poor oil response and unsuccessful fireflood.

Air-fuel combustion results indicate that lower fuel consumption is accompanied by increased front velocity, lower front temperature, and consequently a narrower burning zone. The front velocity is expressed by the following empirical equation:

$$V_f=(0.126F_a/C_{fuel})\text{ft/day} \quad (1)$$

whence $$F_a=7.94V_fC_{fuel}SCF/(\text{ft}^2-\text{hr}) \quad (2)$$

where $C_{fuel}$ is the fuel concentration consumed in lb/ft$^3$ rock and $F_a$ is the flux of air at the combustion front expressed in SCF air per square foot per hour.

At some distance from the injection well $C_{fuel}$ decreases and the front temperature decreases, and at this point, the front thickness decreases rapidly and becomes less efficient, and eventually the front ceases to advance. Increasing the air rate at this time is detrimental to combustion, as higher rates will cool the front further.

Based on these relationships I have found it advantageous to use smaller well patterns for shallow reservoirs, where air injection pressure is limited by the depth of oil formations. Improvement of in situ combustion in reservoirs less than 1000 feet deep is realized by employing well patterns less than 5 acres and preferably 2 to 3 acres. In such reservoirs, the air injection rate, pressure, and entry of air at the sand face should be controlled in a manner to maintain efficient combustion. Firefloods in very shallow reservoirs (less than 500 feet) should be burned at still lower pressures to prevent air breakthrough to the surface. In every case, air injection should remain at or below the pressure limit of the reservoir. Correlations between depth of formations and breakthrough pressure give about 1.0 (one) psi per foot of depth. This pressure gradient value is used for the more shallow formations i.e. up to 2000 feet. A slightly lower value (0.90) may be used for deeper reservoirs.

Even with smaller well patterns the rate of advance of the front decreases as the front advances, and at some point the rate of advance becomes so low that continued operation is uneconomical. I have found that a pratical minimum for $V_f$, the rate of frontal advance, is approximately 0.4 ft/day. This rate of advance is considered a minimum for the front to continue its progress and to sweep most of the reservoir pattern within a reasonable time. According to this invention, when the minimum rate of frontal advance is reached, a second stage of operation is initiated involving the injection of water at the oil-water contact as further described below. If $V_f$ is to have a minimum value of 0.4 ft/day it can be determined from Equation (2), in this case using 1.5 lb/ft$^3$ as a representative value for $C_{fuel}$, that $F_a$ is to have a minimum value of 4.8 or about 5SCF/(ft$^2$−hr).

If another combustion-supporting gas is used such as air (containing 21% oxygen) enriched to P percentage of oxygen, the minimum oxygen flux is 0.21 $F_a$ or about 1.05 SCF oxygen per square foot per hour or a minimum combustion-supporting gas flux $F_g=105/P$ *SCF* gas per square foot per hour, and other equations herein are to be revised accordingly.

In order to know at what point the air flux $F_a$ reaches 5SCF/(ft$^2$−hr) or the rate of frontal advance $V_f$ equals 0.4 ft/day, one uses results obtained from laboratory combustion tube experiments together with the equations developed below.

From laboratory combustion tube experiments the air requirement, (AIR) SCF air/ft$^3$ "burned rock", can be determined for a given sand, API gravity of contained crude oil, air pressure, and type of in situ combustion.

Assuming air is injected into a sand of thickness h feet at the rate Q SCF/day for t days, and assuming the "burned rock" is a right circular cylinder of radius r and thickness hE, where E is the sweep efficiency, which is less than 100% because of air loss by channeling or poor conformance and can be thought of as representing the vertical fraction of the reservoir which is burned; this "burned rock" cylinder has volume $\pi r^2hE$ ft$^3$ and cylindrical surface area $2\pi rhE$ ft$^2$, $$(AIR)\pi r^2hE=Qt,$$

whence $$r=\sqrt{\frac{Qt}{(\text{AIR})\pi hE}}\ \text{ft} \quad (3)$$

$$\text{area of cylindrical surface}=2\sqrt{\frac{Qt\pi hE}{(\text{AIR})}}\ \text{ft}^2,$$

and air flux at cylindrical surface, $$F_a=Q/\text{area}=\frac{1}{48}\sqrt{\frac{Q(\text{AIR})}{\pi hEt}}\ SCF/(\text{ft}^2\text{-hr}),$$

from which $$t=\frac{1}{(48\ F_a)^2}\ \frac{Q(\text{AIR})}{\pi hE}\ \text{days}$$

or by substituting the value 5 for $F_a$, $$t=\frac{1}{57{,}6000}\ \frac{Q(\text{AIR})}{\pi hE}\ \text{days} \quad (4)$$

and Cumulative Air Volume Injected=QT SCF . . . (5)

EXAMPLE

Air requirement for Nacatoch sand, containing 21° API crude oil, in a dry in situ combustion process at 300 psig air pressure is $(AIR)=279SCF$ air/ft$^3$ "burned rock"

$E=0.50$ $Q=1{,}000{,}000SCF$/day $h=30$ ft $V_f=0.4$ ft/day $C_{fuel}=1.57$ lb/ft$^3$ Solving:

Eq. (4) gives t=103 days

Eq. (3) gives r=88.5 ft

Eq. (5) gives Air Volume Injected=103MMCF.

Therefore in this example one would continue operation in accordance with this stage of the invention for 103 days, at which time the front would have advanced approximately 88.5 ft.

Once the air flux $F_a$ has reached a predetermined minimum value, e.g. about 5SCF/(ft$^2$−hr), as determined by the experimental observations and the equations described above, I have found it advantageous to take advantage of the natural tendency of the air to rise to the top of the oil zone. Proper control of air injection should allow the air to float and "ride" the oil zone at this point, and when this stage is reached another controlling step for improving in situ combustion is to inject water at the oil-water contact while air enters the formation just above the water perforations. As air is allowed to "ride" the top of the oil zone it will spread and sustain a larger combustion area which will heat a greater reservoir volume. The air rate at such time should be controlled to prevent large air losses as it breaks through at the producing wells. The producers should be recompleted with flow of oil and gas limited to the lower portion of the oil zone.

This scheme of injecting air on top of water increases the reservoir pressure uniformly which improves the combustion efficiency in shallow reservoirs. This invention comprises two steps for improving in situ combustion in shallow reservoirs: (1) Use small well patterns preferably 2 to 3 acres with injection to producing wells distance about 200 to 250 feet; and (2) after the front reaches a distance where the air flux is about 5SCF/(ft$^2$−hr), or, expressed another way, where the rate of frontal advance is about 0.4 ft/day, allow the air to "ride" on top of the pay zone while simultaneously water is injected at the oil-water contact below the air entry at the sand face of the injection well.

Referring to the Figures, the first stage of operation according to this invention is illustrated in FIG. 1. A heavy crude oil formation or sand 10 of thickness h under overburden 14 of depth D is underlain by a water stratum 11 at oil-water contact 15. Injection well 12 is drilled through overburden 14 and sand 10 and completed with casing 8 and perforations 22 within sand 10. At least one production well 13 is similarly drilled through overburden 14 and sand 10 and completed with casing 9 and perforations 23 within sand 10. Injection well 12 contains tubing 16 with surface connection 18 thereto for injecting fluids into sand 10 through perforations 22. Well 12 also contains surface connection 19 communicating with the annulus between tubing 16 and casing 8. Surface connection 19 is blanked off during the first stage of operation. Production well 13 contains tubing 17 through which produced oil and gas fluids arriving through perforations 23 in well 13 are delivered to the surface.

In the first stage of operation, in situ combustion is initiated in formation or sand 10 in a zone adjacent injection well 12, and air or other combustion-supporting gas injection through connection 18, tubing 16, and perforations 22 is begun to maintain in situ combustion within sand 10 in order to propagate a combustion front 25 to travel between injection well 12 and production well 13. Such gas is injected at a pressure lower than that at which the gas would breakthrough to the surface. As combustion front 25 proceeds through sand 10 it drives oil and gas ahead of it to well 13, where these fluids enter the well through perforations 23 and are delivered to the surface through tubing 17. This sweeping action of front 25 leaves behind it the swept portion 20 of sand 10. The remainder of sand 10 lying ahead of front 25 is shown as unswept portion 30.

Figure 2:
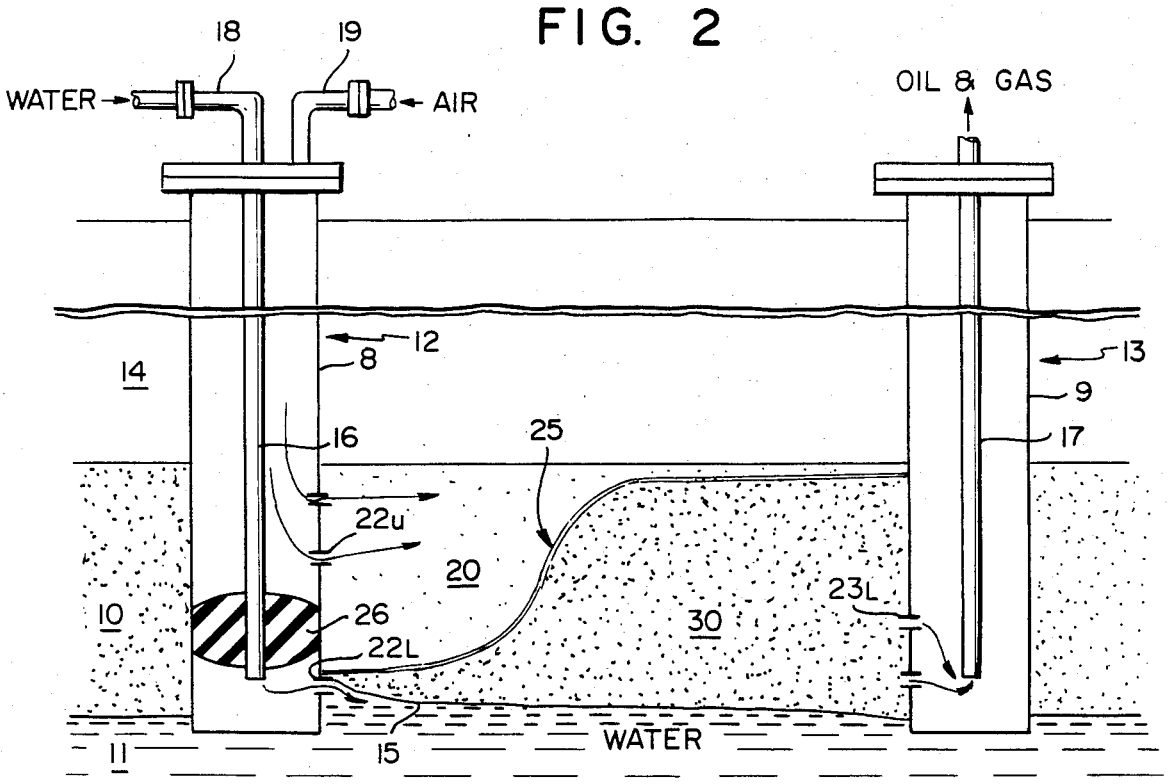
FIG. 2 illustrates the same view of the subterranean formation or sand as FIG. 1 during the second stage of operation according to this invention, in which, after certain criteria regarding the degree of advance of the combustion front have been satisfied, water injection low in the formation is initiated while air injection high in the formation is continued.

At a time determined from relationships between formation and operating parameters as set forth by equations herein the second stage of operation according to this invention is begun, as illustrated in FIG. 2. At this point combustion front 25 has progressed a substantial fraction of the distance from well 12 to well 13. Well 13 is recompleted to have perforations $\mathbf{23}_L$ only low in sand 10. Packer 26 is set low on tubing 16 in well 12, above lower perforations $\mathbf{22}_L$ and below upper perforations $\mathbf{22}_U$ and connection 18 and tubing 16 are converted from air injection to water injection with the water being introduced through perforations $\mathbf{22}_L$ below packer 26 at or near oil-water contact 15. Connection 19 on well 12 is opened and used for continued air injection into sand 10 by way of casing 8 and upper perforations $\mathbf{22}_U$. Air is allowed to "ride" the top of the oil zone and to spread and sustain a larger combustion front 25 in FIG. 2 than in FIG. 1, and thus to heat the greater reservoir volume represented by the unswept portion 30 of the oil-containing formation. The rate of air injection during the second stage is controlled to prevent large air losses as it breaks through at producing well 13.

Operation according to this invention in a typical situation would be planned as illustrated by the following example. The depth D to the heavy crude oil sand 10 is 700 feet, and the thickness of the sand h=50 ft. Pressure of injected air will be kept below 700 psig to avoid breaking through the 700 foot overburden. A sample of the oil sand when tested in the laboratory shows that air requirement (AIR)=260 SCF reacted air/ft$^3$ "burned rock", and experience plus geologic and other information about the formation fix the sweep efficiency at E=45%. Using air compressors which will deliver Q=1,000,000SCF/day, and setting the minimum air flux at 5SCF/(ft$^2$−hr), we get from Equation (4)

t=63.8 days r=58.9 ft.

The size of a suitable inverted 5-spot well pattern would be determined from the following relationship between distance in feet from injection to producing well, d, and the area of the pattern in acres, A $d=43{,}560A/2$ feet.

TABLE 2

| Area A acres | Distance d feet |
|---|---|
| 5 | 330 |
| 4 | 295 |
| 3 | 256 |
| 2 | 209 |
| 1 | 148 |

It is desired to use a well pattern of large area in order to minimize the cost of drilling, and yet to use a pattern of small distance, d, in order that the procedure according to the first stage of this invention will be applied to a substantial portion of the reservoir. A reasonable compromise would be to drill wells for a 2 to 3 acre pattern, thus making the distance, r=58.9 ft, covered by the first stage of operation equal to 28% to 23% of the pattern distance, d=209 to 256 ft.

At this point the second stage of operation according to this invention would be started, with the injection of water at the oil-water contact while continuing air injection into the formation just above the water perforations. As air is allowed to "ride" the top of the oil zone it will spread and sustain a larger combustion area which will heat a greater reservoir volume. The air rate at such time should be controlled to prevent large air losses as it breaks through at the producing wells.

SUMMARY OF RELATIONSHIPS BETWEEN FORMATION AND OPERATING PARAMETERS $$V_f=(0.126F_a/C_{fuel})\text{ft/day} \quad (1)$$

$$F_a=7.94V_fC_{fuel}SCF/(\text{ft}^2-\text{hr}) \quad (2)$$

$$r=\sqrt{\frac{Qt}{(\text{AIR})\pi hE}}\ \text{ft} \quad (3)$$

$$t=\frac{1}{57{,}600}\ \frac{Q(\text{AIR})}{\pi hE}\ \text{days} \quad (4)$$

where $F_a$ is the flux of air at the combustion front expressed in SCF air per square foot per hour, $V_f$ is combustion front rate of travel or velocity in ft/day, $C_{fuel}$ is the fuel concentration consumed in lb/ft$^3$ rock, r is the distance traveled by the combustion front from the injection well in feet, t is the time of operation of the in situ combustion procedure in days, (AIR) is the air requirement of the sand with its particular API gravity of contained crude oil, and at the operating conditions of air pressure and type of in situ combustion, as determined from laboratory combustion tube experiments, expressed in SCF air/ft$^3$ "burned rock", h is the thickness of the sand in feet, and E is the sweep efficiency in the formation.

While particular embodiments of the invention have been described above in accordance with the applicable statutes this is not to be taken as in any way limiting the invention but merely as being descriptive thereof. All such embodiments are intended to be included within the scope of the invention which is to be limited only by the following claims.

What is claimed is:

1. The method of carrying out an in situ combustion operation for the production of hydrocarbons from an underground formation containing heavy crude oil, said formation being penetrated by an injection well and at least one production well and being underlain by a water stratum at an oil-water contact, which comprises initiating in situ combustion in said formation in a zone adjacent said injection well, introducing into said formation via said injection well bore to maintain in situ combustion therein a combustion-supporting gas at a pressure lower than that at which said gas would break through to the surface in order to propagate a combustion front to travel between said injection and production wells, at a time determined from known relationships between formation and operating parameters injecting water in said injection well at about the level of said oil-water contact to increase reservoir pressure acting against a combustion front as the latter moves toward the production well while continuing injection of combustion supporting gas into said formation, and producing hydrocarbon fluids through said at least one production well.

2. The method of carrying out an in situ combustion operation for the production of hydrocarbons from an underground formation containing heavy crude oil, said formation being penetrated by an injection well and at least one production well and being underlain by a water stratum at an oil-water contact, which comprises initiating in situ combustion in said formation in a zone adjacent said injection well, introducing into said formation via said injection well bore to maintain in situ combustion therein a combustion-supporting gas at a pressure lower than that at which said gas would break through to the surface in order to propagate a combustion front to travel between said injection and production wells, when either one of the following two criteria is satisfied, (1) the rate of travel of said combustion front is not greater than a predetermined rate of travel, and (2) the flux of combustion-supporting gas at said front has a combustion-supporting capacity not greater than a predetermined combustion-supporting capacity, injecting water in said injection well at about the level of said oil-water contact while continuing injection of combustion supporting gas into said formation, and producing hydrocarbon fluids through said at least one production well.

3. The method as in claim 2 wherein said combustion-supporting gas is air and the flux of air at said front is not greater than 5SCF air per square foot per hour.

4. The method as in claim 2 wherein said combustion-supporting gas is air and the rate of travel of said combustion front is not greater than 0.4 feet per day.

5. The method of carrying out an in situ combustion operation for the production of hydrocarbons from an underground formation containing heavy crude oil by propagating a combustion front to travel through said formation, said formation being underlain by a water stratum at an oil-water contact, which comprises determining by known relationships between formation and operating parameters (1) the time for said combustion front to reach a predetermined rate of travel and (2) the distance traveled by said combustion front during said determined time, drilling an injection well, drilling at least one production well at a distance from said injection well which bears a predetermined relationship to said determined distance traveled by said combustion front, initiating in situ combustion in said formation in a zone adjacent said injection well, introducing into said formation via said injection well bore to maintain in situ combustion therein a combustion-supporting gas at a pressure lower than that at which said gas would break through to the surface, at said determined time, injecting water in said injection well at about the level of said oil-water contact while at a sufficient rate to increase reservoir pressure against the combustion front whereby to maintain the rate of travel thereof toward said production well continuing injection of combustion-supporting gas into said formation, and producing hydrocarbon fluids through said at least one production well.

6. The method as in claim 5 wherein said distance from injection well to production well is not greater than about five times and not less than about three times said determined distance traveled by said combustion front.

7. The method as in claim 5 wherein said combustion-supporting gas is air and said predetermined value for combustion front rate of travel is not greater than about 0.4 ft/day.

* * * * *